US005852359A

United States Patent [19]

Callahan, Jr. et al.

[11] Patent Number: 5,852,359

[45] **Date of Patent: *Dec. 22, 1998**

[54] VOLTAGE REGULATOR WITH LOAD POLE STABILIZATION

[75] Inventors: Michael J. Callahan, Jr., Austin, Tex.; William E. Edwards, St. Paul, Minn.

[73] Assignee: STMicroelectronics, Inc., Carrollton, Tex.

[ * ] Notice: The term of this patent shall not extend beyond the expiration date of Pat. No. 5,648,718.

[21] Appl. No.: 889,816

[22] Filed: Jul. 8, 1997

Related U.S. Application Data

[63] Continuation-in-part of Ser. No. 536,436, Sep. 29, 1995, Pat. No. 5,648,718.

[51] Int. Cl.[6] ..... G05F 1/40; G05F 1/44; H03F 1/36; H03F 3/52

[52] U.S. Cl. ..... 323/274; 323/280; 330/109

[58] Field of Search ..... 323/273, 274, 323/275, 280; 330/109

[56] References Cited

U.S. PATENT DOCUMENTS

| | | | |
|---|---|---|---|
| 3,946,328 | 3/1976 | Boctor | 330/109 |
| 4,349,775 | 9/1982 | Kwon et al. | 320/35 |
| 4,628,247 | 12/1986 | Rossetti | 323/314 |
| 4,908,566 | 3/1990 | Tesch | 323/280 |
| 4,912,423 | 3/1990 | Milkovic et al. | 330/255 |
| 4,954,785 | 9/1990 | Segaram | 328/167 |
| 4,970,474 | 11/1990 | Kennedy et al. | 331/2 |
| 4,972,446 | 11/1990 | Kennedy et al. | 377/47 |
| 4,983,905 | 1/1991 | Sano et al. | 323/274 |
| 5,124,593 | 6/1992 | Michel | 307/521 |
| 5,168,209 | 12/1992 | Thiel | 323/313 |

(List continued on next page.)

FOREIGN PATENT DOCUMENTS

| | | | |
|---|---|---|---|
| 0 377 327 A2 | 7/1990 | European Pat. Off. | H02K 9/10 |
| 0 531 945 A2 | 3/1993 | European Pat. Off. | G05F 1/56 |
| 0 745 923 A2 | 12/1996 | European Pat. Off. | G05F 3/26 |
| 0 766 164 A2 | 4/1997 | European Pat. Off. | G05F 3/26 |

OTHER PUBLICATIONS

Malley, K., "Understanding Linear–Regulator Compensation," *Electronic Design,* 42(17):123–124, 126, 128, 1994.

Williams and Gross, "La Contre–Reaction en Courant S'Impose A Frequence Elevee," *Electronique,* 2045(19):68–72, 1992.

Grenebe, A., *Bipolar and MOS Analog Integrated Circuit Design,* John Wiley & Sons, New York, 1984, pp. 706–713.

*Primary Examiner*—Robert E. Nappi
*Assistant Examiner*—Bao Q. Vu
*Attorney, Agent, or Firm*—David V. Carlson; Theodore E. Galanthay; Lisa K. Jorgenson

[57] ABSTRACT

A voltage regulator with load pole stabilization is disclosed. The voltage regulator consists of an error amplifier, an integrator which includes a switched capacitor, a pass transistor, and a feedback circuit. In one embodiment, the integrator circuit includes an amplifier, a capacitor, and a switched capacitor which is driven by a voltage controlled oscillator. The voltage controlled oscillator changes its frequency of oscillation proportional to the output current. In another embodiment, the switched capacitor is driven by a current controlled oscillator whose frequency of oscillation is also proportional to the output current of the voltage regulator. When the output current demand is large, the controlled oscillators increase the frequency which decreases the effective resistance of the switched capacitor thereby changing the frequency of the zero to respond to the change in the load pole. Conversely, the effective resistance is increased as the current demand is decreased, also to respond to the decrease in load pole. The controlled oscillator may be coupled to a current sensing device that generates a scaled version of the load current and couples to the regulated voltage output. The controlled oscillator is restricted to operating voltages that are related to the regulated output voltage and a control current that is a scaled version of the load current. Consequently, the disclosed voltage regulator has high stability without consuming excess power.

33 Claims, 6 Drawing Sheets

U.S. PATENT DOCUMENTS

| | | | |
|---|---|---|---|
| 5,191,278 | 3/1993 | Carpenter | 323/275 |
| 5,319,303 | 6/1994 | Yamada | 323/313 |
| 5,338,977 | 8/1994 | Carobolante | 307/270 |
| 5,384,554 | 1/1995 | Abernethy | 331/153 |
| 5,552,697 | 9/1996 | Chan | 323/282 |
| 5,629,608 | 5/1997 | Budelman | 323/274 |

VOLTAGE REGULATOR WITH LOAD POLE STABILIZATION

CROSS-REFERENCE TO RELATED APPLICATION

This application is a continuation-in-part of U.S. patent application Ser. No. 08/536,436, filed Sep. 29, 1995, now U.S. Pat. No. 5,648,718.

BACKGROUND OF THE INVENTION

1. Field of the Invention

This invention relates to electronic circuits used as voltage regulators and more specifically to circuits and methods used to stabilize a voltage regulator.

2. Description of the Relevant Art

The problem addressed by this invention is encountered in voltage regulation circuits. Voltage regulators are inherently medium to high gain circuits, typically greater than 50 db, with low bandwidth. With this high gain and low bandwidth, stability is often achieved by setting a dominant pole set using load capacitor. The load that draws current from the voltage regulator may be characterized as a load resistor whose resistance value varies as the load current varies. Achieving stability over a wide range of load currents with a low value load capacitor (~0.1 uF) is difficult because the load pole formed by the load capacitor and load resistor can vary by more than three decades of frequency and be as high as tens of kilohertz (kHz) requiring the circuit to have a very broad bandwidth of greater than 3 megahertz (MHz) which is incompatible with the power process used for voltage regulators.

FIG. 1 shows a prior art solution to the stabilization problem. The voltage regulator 2 in FIG. 1 converts an unregulated $V_{dd}$ voltage, 12 volts in this example, into a regulated voltage $V_{reg}$, 5 volts in this example. Amplifier 6, and capacitor 12 are configured as an integrator setting the dominant pole of the system. Resistor 10 & C12 form a zero to cancel the pole of the load (load pole). The integrator drives pass transistor 8. Resistors 14 and 16 form a voltage divider circuit which is used to scale the regulated voltage $V_{reg}$ such that the regulated voltage can be fed back to the inverting input of an error amplifier 4. Resistor 18 and capacitor 20 are not part of voltage regulator 2 but rather are the schematic representation of the typical load on the voltage regulator circuit.

In this prior art example, the pole associated with the pull down resistors and load can be calculated as:

$$f_{pole} = \frac{1}{2\Pi C_L R_L} \tag{1}$$

where $R_L$ is the resistance of the load, which is equal to the series combination of R14 and R16 in parallel with R18, and $C_L$ is the capacitance of C20, which is typically around 0.1 microfarad.

Therefore, the pole associated with the prior art circuit is load dependent and can vary from 16 Hz to 32 kHz for an R14+R16 equal to 100 kilohms (kΩ) and R18 ranging from 50 ohms to 1 megaohm (MΩ). The wide variation of the pole frequency is difficult to stabilize, as will be appreciated by persons skilled in the art. A prior art solution to this problem is to change the pull down resistors R14+R16 from 500 kΩ to around 500 Ω which changes the pole frequency to a range of 3.2 kHz to 32 kHz, which is a frequency spread of 1 decade instead of 3 decades. However, the power dissipated in the pass transistor 8 (FIG. 1) increases, as shown below:

$$\text{Power}=(12\text{v}-5\text{v})(I_{load}+I_{pulldown})=(7\text{v})(100\text{mA})+(7\text{v})(10\text{mA}) \tag{2}$$

Therefore, the 500 ohm resistor adds 70 milliwatts of power dissipation in the chip which is approximately a 10% increase in power dissipation for the added stability.

Therefore, it can be appreciated that there is a significant need for a voltage regulator circuit that will increase the stability of the voltage regulator without increasing the power dissipated in the circuit. The present invention provides this and other advantages as will be apparent from the detailed description and accompanying figures.

SUMMARY OF THE INVENTION

The invention can be summarized as a voltage regulator with load pole stabilization. The voltage regulator consists of an amplifier, which includes a switched capacitor, a pass transistor, and a feedback circuit. In one embodiment, the integrator circuit includes an amplifier, a capacitor, and a switched capacitor which is driven by a voltage controlled oscillator. The voltage controlled oscillator changes its frequency of oscillation as a function of the output current of the voltage regulator. In another embodiment, the switched capacitor is driven by a current controlled oscillator whose frequency of oscillation is also a function of the output current of the voltage regulator. When the output current demand is large, the controlled oscillator increases the frequency of oscillation which decreases the effective resistance of the switched capacitor, thereby changing the frequency of the cancellation zero to respond to the change in the load pole. Conversely, the effective resistance is increased as the current demand is decreased, also to respond to the decrease in load pole. Consequently, the disclosed voltage regulator has high stability without consuming excess power.

DETAILED DESCRIPTION OF THE PREFERRED EMBODIMENT

Figure 1:
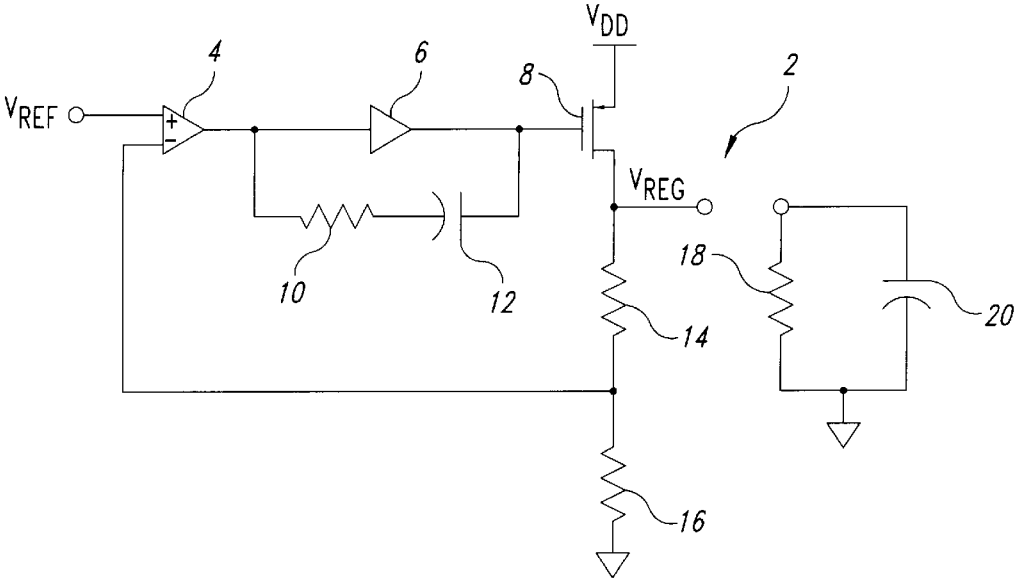
Fig. 1 (PRIOR ART)
FIG. 1 is a schematic diagram of a voltage regulator as is known in the prior art.

A voltage regulator 22 constructed according to the embodiment of the invention in FIG. 2 will now be described. Error amplifier 24 has a noninverting input for receiving a reference voltage $V_{ref}$. The output of the error amplifier 24 is coupled to the integrator circuit and more specifically to the input of an amplifier 26 and to the first end of a switched capacitor 30. The second end of the switched capacitor 30 is coupled to the first end of a capacitor 32. The second end of the capacitor 32 is connected to the output of amplifier 26, the gate of a P-channel MOSFET pass transistor 28 and the input of a voltage controlled oscillator (VCO) 42. The output of the VCO 42 is coupled to the input of the switched capacitor 30. The source of the pass transistor 28 is connected to a voltage source $V_{dd}$. The drain of pass transistor 28 forms the output of the voltage regulator 22 and is connected to the first end of a resistor 34. The second end of the resistor 34 is connected to the first end of a resistor 36 and the inverting input of the error amplifier 24. The second end of the resistor 36 is connected to ground.

In operation, the error amplifier 24 compares the reference voltage $V_{ref}$ with the regulated voltage $V_{reg}$, which is supplied to the error amplifier through the feedback circuit formed by resistor 34 and resistor 36. More specifically, the resistors 34 and 36 are configured as a voltage divider to scale the regulated voltage $V_{reg}$ which is then fed back to the inverting input of the error amplifier 24.

The integrator formed by the amplifier 26, the switched capacitor 30 and the capacitor 32 has a zero with a frequency at $$f_{zero} = \frac{1}{2\pi C_{32} R_{eff}} \tag{3}$$

where $$R_{eff} = \frac{1}{f_{vco} C_{30}} \tag{4}$$

Thus, the pass transistor 28 regulates the voltage source $V_{DD}$ in response to the error amplifier 24 and integrator output, thereby generating the regulated voltage $V_{reg}$.

Figure 2:
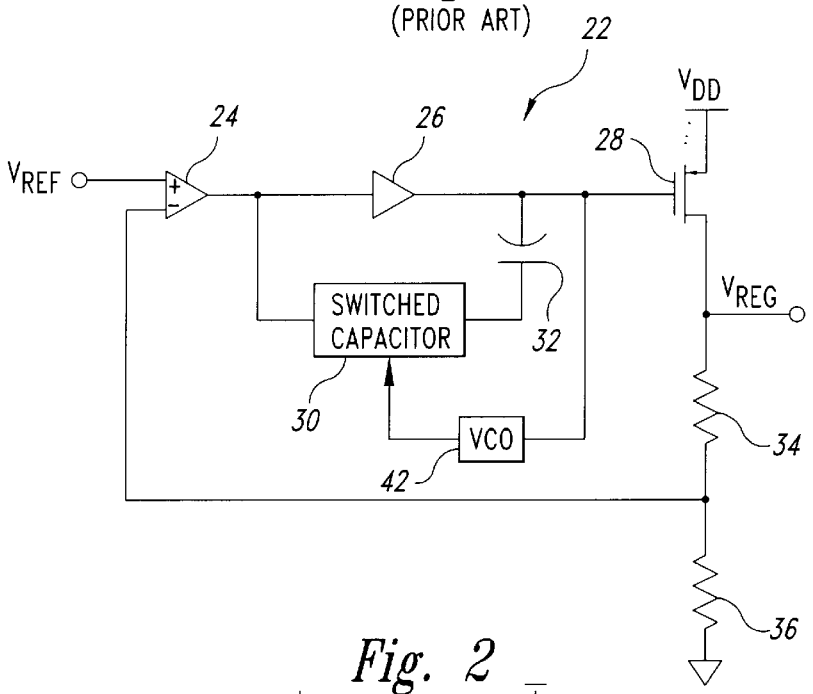
FIG. 2 is a schematic diagram of a voltage regulator with a switched capacitor, driven by a voltage control oscillator, in the integrator circuit.

FIG. 2 also shows the switched capacitor 30 being switched at a frequency controlled by the VCO 42. The voltage control input of the VCO 42 is connected to the output of the integrator circuit. The operation of this circuit can be described with the following equations:

$$f_{pole} = \frac{1}{2\Pi R_L C_L} \tag{5}$$

$$f_{zero} = \frac{1}{2\Pi C_{32} R_{eff}} \tag{6}$$

By setting the load pole frequency equal to the regulator zero frequency and solving for the VCO frequency, we obtain:

$$f_{vco} = \frac{C_{32}}{C_{30}} \quad \frac{1}{R_L C_L} \tag{7}$$

and, $$f_{vco} = \frac{C_{32}}{C_{30}} \quad \frac{I_{load}}{V_{reg}} \quad \frac{1}{C_L} \tag{8}$$

Therefore, the frequency of the VCO 42 is proportional to the value of the switching capacitor C32 and to the output current in this example. Thus, the cancellation zero to the integrator follows the load pole as the load changes. Examples of voltage regulators are provided below. Persons skilled in the art will be able to utilize the teachings of the present invention to design various embodiments of the voltage regulator which meets their design criteria.

The invention increases the stability of the voltage regulator 22 without increasing the power dissipated by the circuit. This is accomplished by having a load canceling zero which follows the load pole without having to use low resistance pull down resistors which dissipate excessive power, as described above.

Figure 3:
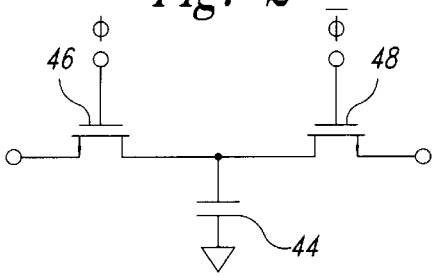
Fig. 3 (PRIOR ART)
FIG. 3 is a schematic diagram of a switched capacitor as known in the prior art.

The construction of a switched capacitor as illustrated in FIG. 3 will now be described. FIG. 3 shows a switched capacitor 44 having a first end connected to the drain of MOSFET transistor 46 and the drain of MOSFET transistor 48 and having a second end connected to ground. The source of transistor 46 forms the input to the switched capacitor and the source of transistor 48 forms the output of the switched capacitor. The gate of transistor 46 is shown to receive a signal $\phi$ while the gate of transistor 48 is shown to receive the inverted signal $\overline{\phi}$. It will be understood by persons skilled in the art that transistors 46 and 48, although shown as N-channel transistors, could be P-channel MOSFETS, or any equivalent or combination thereof.

Figure 4A:
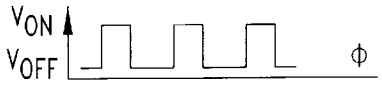
FIGS. 4A and 4B are timing diagrams describing the operation of a switched capacitor.
Figure 4B:
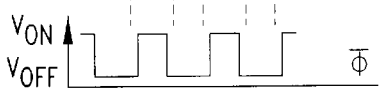
Figure 4C:
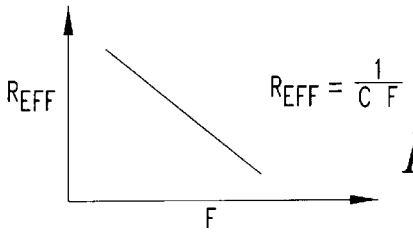
FIG. 4C is a graph illustrating the relationship of effective resistance and frequency.

FIG. 4 shows the input timing signals as well as the effective resistance of the circuit as a function of frequency. FIG. 4A shows the input waveform $\phi$ that is applied to the gate of transistor 46. FIG. 4B shows the timing waveform for the signal $\overline{\phi}$ that is applied to the gate of transistor 48. It should be noted that these are non-overlapping waveforms. Therefore, transistor 46 is never on at the same time that transistor 48 is on. FIG. 4C shows that the effective resistance $R_{eff}$ of the switched capacitor decreases as the frequency increases. Conversely, the effective resistance $R_{eff}$ increases as frequency decreases.

Figure 5:
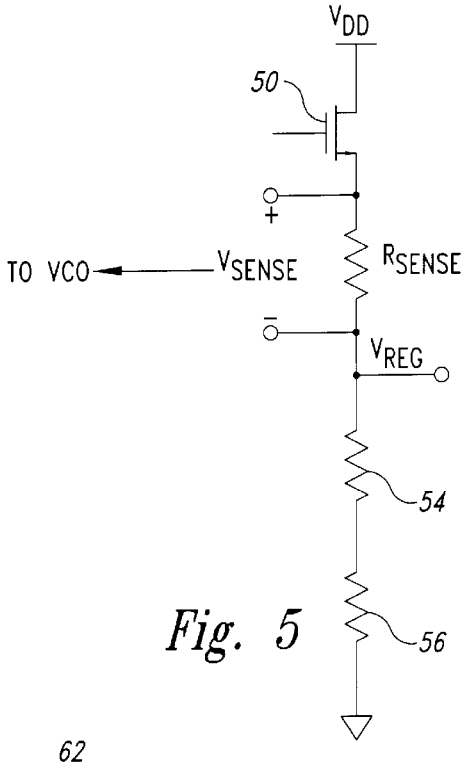
FIG. 5 is a schematic diagram of a voltage sense circuit which can be used in conjunction with a voltage control oscillator.

FIG. 5 illustrates a circuit that provides a voltage which is proportional to the output current of the voltage regulator 22. The circuit in FIG. 5 provides an alternative embodiment to the method for driving the VCO 42 in FIG. 2.

More specifically, FIG. 5 shows a pass transistor 50 connected in series with a sense resistor $R_{sense}$ to generate a voltage which can be used by the VCO 42. FIG. 5 is shown as an alternative to connecting the VCO 42 to the gate of the pass transistor 28 in FIG. 2. Further, FIG. 5 shows the first end of the sense resistor $R_{sense}$ connected to the source of pass transistor 50. The second end of the sense resistor $R_{sense}$ forms the output of the voltage regulator 22 and is coupled to the first end of the resistor 54. The second end of resistor 54 is connected to first end of resistor 56. The second end of resistor 56 is connected to ground. The resistors 54 and 56 are part of the feedback circuit to couple the regulated voltage $V_{reg}$ to the inverting input of the error amplifier 24 (see FIG. 2) as previously described. It will be appreciated by persons skilled in the art that $R_{sense}$ would be selected such that the voltage drop across $R_{sense}$ is minimized.

With $R_{sense}$ configured in this manner, a voltage $V_{sense}$ is generated which is proportional to the output current of the voltage regulator 22. This voltage can subsequently be used to control the VCO 42.

Figure 6:
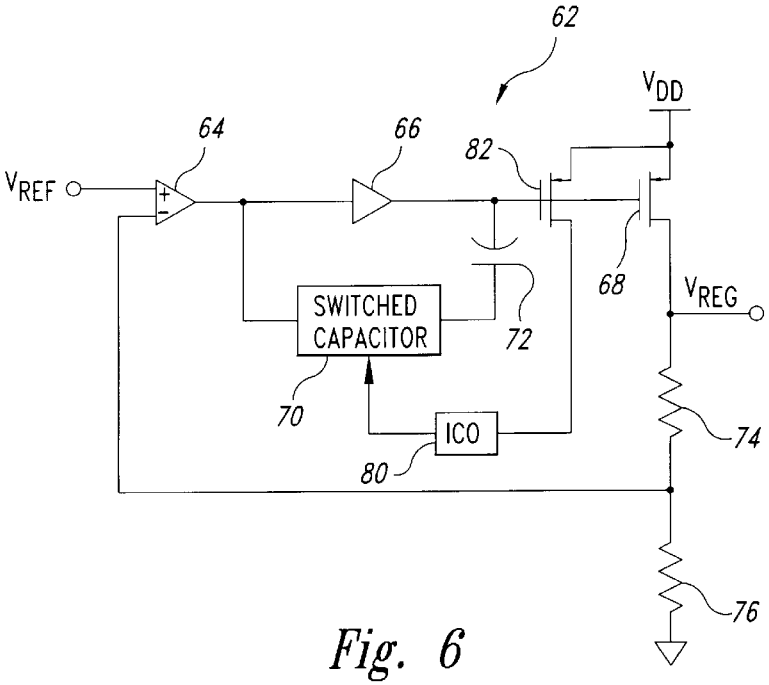
FIG. 6 is another embodiment of a voltage regulator with a switched capacitor driven by a current controlled oscillator.

Another embodiment of a voltage regulator 62 is shown in FIG. 6. The embodiment in FIG. 6 differs from the embodiment in FIG. 2 in that a switched capacitor 70 is controlled by a current controlled oscillator (ICO) 80 whereas the switched capacitor 30 in FIG. 2 is controlled by the VCO 42.

The voltage regulator 62 in FIG. 6 is constructed by having an error amplifier 64 receive a reference voltage $V_{ref}$ into its noninverting input. The output of the error amplifier 64 is connected to the input of an amplifier 66 and to the first end of the switched capacitor 70. The output of the amplifier 66 is connected to the gate of a P-channel transistor 82 and the gate of a P-channel transistor 68 and the second end of the capacitor 72. The first end of the capacitor 72 is connected to the second end of the switched capacitor 70. The frequency input of the switched capacitor 70 is connected to the output of the ICO 80. The control input of the ICO 80 is connected to the drain of the transistor 82. The drain of the transistor 68 forms the output of the voltage regulator 62. Resistors 74 and 76 form a voltage divider and feedback network. The drain of the pass transistor 68 is connected to the first end of the resistor 74. The second end of the resistor 74 is connected to the inverting input of the error amplifier 64 and the first end of the resistor 76. The second end of the resistor 76 is connected to ground.

The voltage regulator circuit in FIG. 6 operates essentially the same way as the voltage regulator 22 in FIG. 2. The difference between these two circuits is that the circuit in FIG. 6 measures the output current by connecting the gate and source of the transistor 82 to the gate and source, respectively, of the pass transistor 68. The transistor 82 functions as a current sensing transistor. Therefore, as the output current through the pass transistor 68 increases, the current going through the current sensing transistor 82 and into the ICO 80 also increases. As the current at the control input of the ICO 80 increases, the frequency of the signal generated by the ICO and going to the switched capacitor 70 increases. Therefore, the resistance of switched capacitor 70 decreases. Like the circuit in FIG. 2, the cancellation zero generated by the integrator follows the load pole as the load changes.

The fundamental relationship between the frequency of the voltage controlled oscillator 42 (see FIG. 2) and current in the load 18 (see FIG. 1) is provided by equation (8) above. Using equation (8), it is possible to synthesize a practical VCO 42 with limits on the control voltage in order to guarantee proper operation of the VCO. As is known by those of ordinary skill in the art, the VCO 42 (see FIG. 2), or ICO 80 (see FIG. 6), must have some limitation on the control signal, and output frequency. If the maximum or minimum control signal range is exceeded, the VCO 42 will be unable to respond and will remain at its minimum or maximum frequency, respectively. This may occur if the load capacitance $C_L$ is excessively large or if the center frequency of the VCO 42 is improperly calculated. As a result of such improper circuit design, the zero created by the voltage regulator 22 will not cancel or track the pole of the load in the desired manner.

Although FIGS. 2 and 6 illustrate embodiments of the invention where variable compensation is provided between the input and output terminals of the amplifier 26 (see FIG. 2) or amplifier 66 (see FIG. 6), those of ordinary skill in the art will recognize that compensation may be used at other points in the voltage regulator circuit. The present invention is directed to a technique for providing variable compensation to the voltage regulator to compensate for changes in the load current. Accordingly, the present invention is not limited by the precise location of the compensation components within the regulator circuit.

Figure 7:
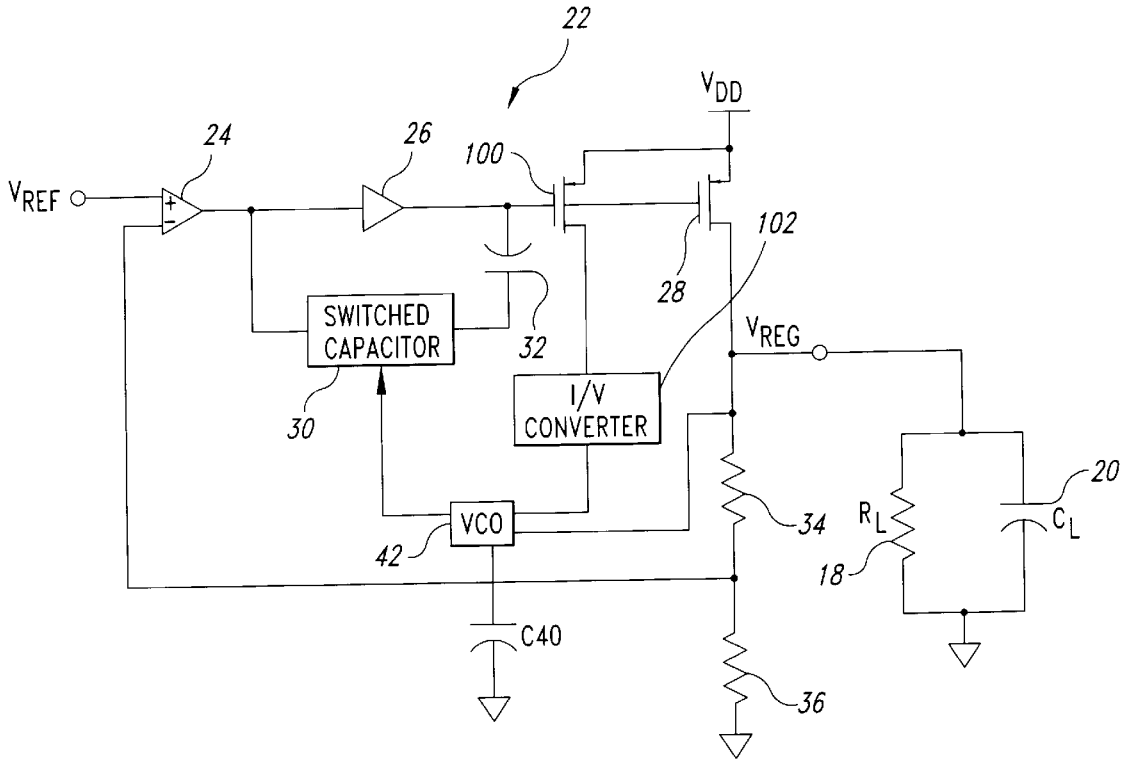
FIG. 7 is a schematic of a practical implementation of the voltage regulator of FIG. 2.

A practical implementation of the voltage regulator 22 is illustrated in the functional block diagram of FIG. 7. Many of the components illustrated in FIG. 7 have been previously described, and need not be described again. The voltage regulator 22 includes a current sensing transistor 100, which is preferably selected to match the characteristics of the pass transistor 28. Persons skilled in the art will appreciate that there are numerous ways to achieve a known, predictable relationship between the typically large load current through the pass transistor 68, and a preferably smaller current through the current sensing transistor 82. The gate and source terminals of the transistor 100 are connected in parallel with the gate and source terminals, respectively, of the pass transistor 28. With proper matching in the transistor characteristics of the current sensing transistor 100 and the pass transistor 28, the drain current of the current sensing transistor 100 is proportional to the load current $I_{load}$. The drain current in the current sensing transistor 100 may be represented by $\alpha I_{load}$ where $\alpha$ is less than 1. With the proper scaling, the drain current of the current sensing transistor 100 closely tracks the load current $I_{load}$, but with significantly lower current drain so as to minimize power consumption.

The drain current $\alpha I_{load}$ of the current sensing transistor 100 is converted to a control voltage by a current-to-voltage converter 102. The current-to-voltage converter 102 may be any form of well-known conversion circuit, such as a linear resistor or the like. The control voltage, which is proportional to the load current $I_{load}$ is provided as an input to the VCO 42. In addition, the regulated output voltage $V_{reg}$ is also provided as an input to the VCO 42. A control capacitor C40 is alternately charged and discharged by the VCO 42 to create time varying waveform whose frequency is dependent on the load current $I_{load}$. The regulated voltage $V_{reg}$ is used to set the minimum and maximum voltage levels on the control capacitor C40 so that the control voltages are appropriately limited by the regulated voltage $V_{reg}$. This prevents operation of the VCO 42 at voltage levels that exceed the minimum or maximum control voltage levels and ensures proper operation of the VCO.

As noted above, different techniques may be used to sense the load current $I_{load}$. For example, the resistor $R_{sense}$ (see FIG. 5) can be used to sense the load current $I_{load}$. The advantage of the current sensing transistor 100 over the sensing resistor $R_{sense}$ is that the current sensing transistor dissipates very little power and has minimal drain current $\alpha I_{load}$. Alternatively, the load current $I_{load}$ could be determined by measuring the gate-source potential ($V_{GS}$) for the pass transistor 28. Using known $V_{GS}$ for a known MOS transistor, it is possible to predict the load current $I_{load}$ based on $V_{GS}$.

Figure 8A:
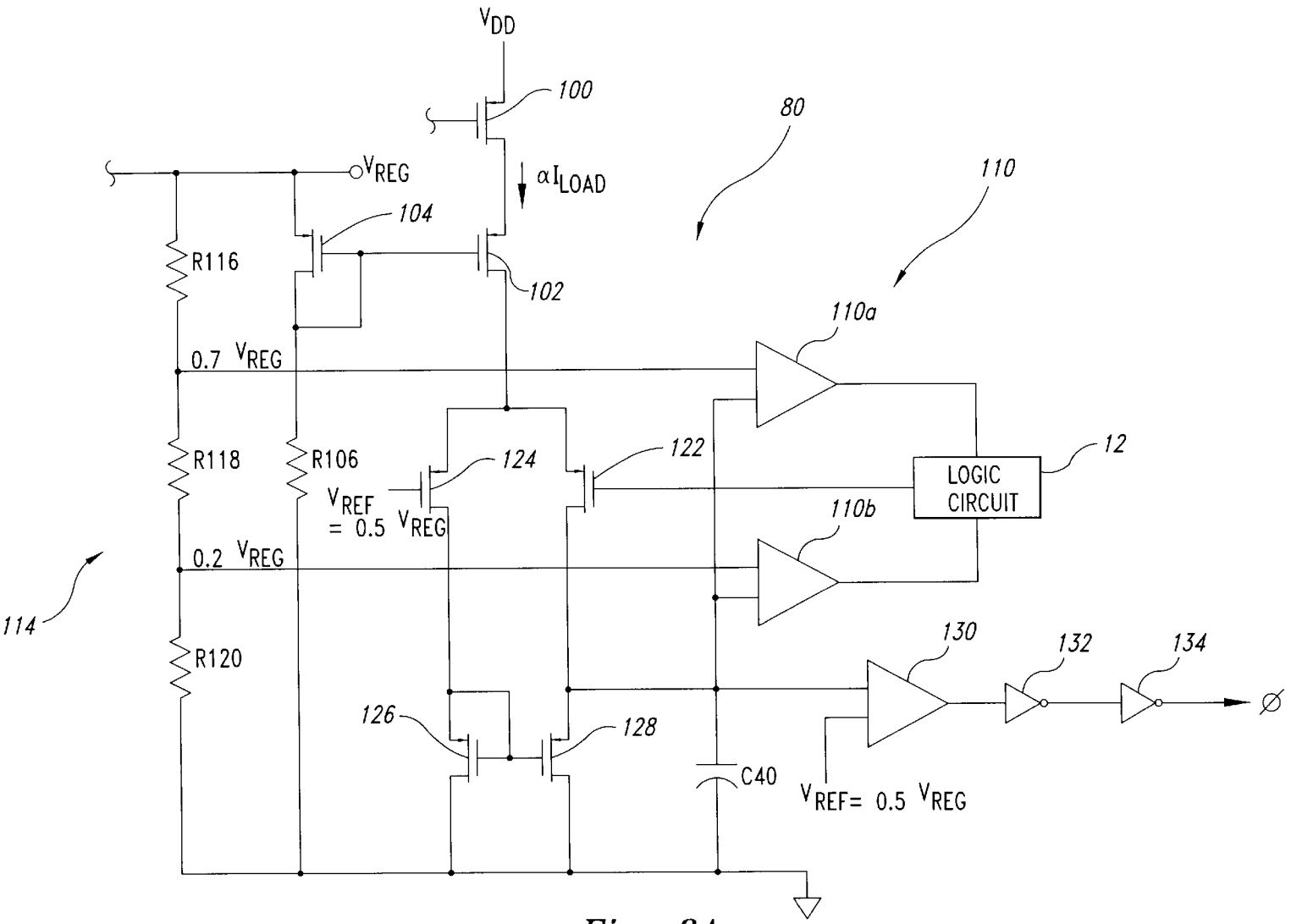
FIG. 8A is a detailed schematic diagram of a practical implementation of the voltage regulator of FIG. 6.

A practical implementation of the ICO 80 is illustrated in FIG. 8A. In FIG. 8A, the current sensing transistor 100 is connected in the manner described above. That is, the gate and source of the current sensing transistor 100 are connected to the gate and source, respectively, of the pass transistor 68. The drain current $\alpha I_{load}$ in the current sensing transistor 100 is a scaled version of the load current $I_{load}$.

Transistors 102 and 104 force the drain of the current sensing transistor 100 to equal the regulated voltage $V_{reg}$ on the drain of the pass transistor 68. Transistor 104 is used in a diode configuration wherein the gate and drain are coupled together and tied to circuit ground through a resistor R106. The resistor R106 provides a current path for the transistor 104 and is selected to provide a current that is nominally equal to the current flowing through the transistor 102. The source of transistor 104 is connected to the regulated voltage $V_{reg}$. The gate and drain of the transistor 104, which are connected together, are also coupled to the gate of the transistor 102. The source of the transistor 102 is coupled to the drain of the current sensing transistor 100. In this configuration, the gates of transistors 102 and 104 are both at a voltage potential approximately one diode drop below the regulated voltage $V_{reg}$. Thus, the source of transistor 102, and the drain of the current sensing transistor 100, are at approximately the same voltage (i.e., $V_{reg}$) as the drain of the pass transistor 68 (see FIG. 6). Therefore, the scaled drain current $\alpha I_{load}$ very closely follows the actual load current $I_{load}$ because the gate and source of the current sensing transistor are connected to the gate and source of the pass transistor 68 and the drain of the current sensing transistor 100 is maintained at substantially the same voltage as the drain of the pass transistor 68. As previously noted, the current sensing transistor 100 is selected to have similar characteristics as the pass transistor 68.

The scaled load current $\alpha I_{load}$ passes through transistor 102 and is used to alternately charge and discharge the control capacitor C40. The charging and discharging of the control capacitor C40 is regulated by a window comparator 110 and logic circuit 112. The window comparator 110 comprises an upper window comparator 110*a* and a lower window comparator 110*b*. In an exemplary embodiment, the upper and lower window comparators 110*a* and 110*b* may have hysteresis to assure satisfactory operation in the presence of low levels of noise. The upper and lower window comparators 110*a* and 110*b* are each coupled to the control capacitor C40 to sense the voltage thereon. In addition, a reference input of the upper and lower window comparators 110*a* and 110*b* are each connected to different reference voltages in a resistor divider 114. The resistor divider 114 comprises resistors R116, R118, and R120 connected in series between the regulated voltage $V_{reg}$ and ground. The resistor divider simply provides reference voltages used by the window comparator 110. The resistance values of the resistors R116 to R120 are selected to provide a first voltage value of approximately 0.7 $V_{reg}$ to the reference input of the upper window comparator 110*a* and a second voltage value of approximately 0.2 $V_{reg}$ to the reference input of the lower window comparator 110*b*. Thus, the reference inputs of the upper and lower window comparators 110*a* and 110*b* are coupled to voltages that are related to the regulated voltage $V_{reg}$. It should be noted that the voltages provided by the resistor divider 114 are nominally selected to provide approximately 0.5 $V_{reg}$ as the upper and lower values for the window comparator 110. However, those of ordinary skill in the art will recognize that other voltage values may be readily employed. For example, the reference input of the upper window comparator 110*a* can be coupled directly to the regulated voltage $V_{reg}$ or to any other suitable reference voltage level. Similarly, the reference input of the lower window comparator 110*b* can be coupled directly to the circuit ground, or to any suitable voltage reference level less than the voltage reference level coupled to the reference input of the upper window comparator 110*a*. As will be described in detail below, the control capacitor C40 is charged to the first voltage reference level at the reference input of the upper window comparator 110*a* and discharged to the second voltage reference level at the reference input of the lower window comparator 110*b*. In this manner, the charging of the control capacitor C40 is related to the regulated voltage $V_{reg}$.

The window comparator 110 controls the charging and discharging cycles of the control capacitor C40 using the logic circuit 112. In an exemplary embodiment, the logic circuit 112 is simply a flip-flop, such as an S-R flip-flop. The output of the logic circuit 112 is connected to the gate of a transistor 122. The transistor 122 operates in conjunction with additional transistors 124, 126 and 128 to form a current steering circuit. The drain of the transistor 102 is coupled to the sources of the transistors 122 and 124. The drain of transistor 122 is coupled to the control capacitor C40 and the source of transistor 128. The drain of transistor 124 is coupled to the gate and the source of transistor 126 and the gate of transistor 128. The gate of the transistor 124 is connected to a reference voltage of approximately 0.5 $V_{reg}$. The drain of transistor 126 and the drain of transistor 128 are connected to ground.

Figure 8B:
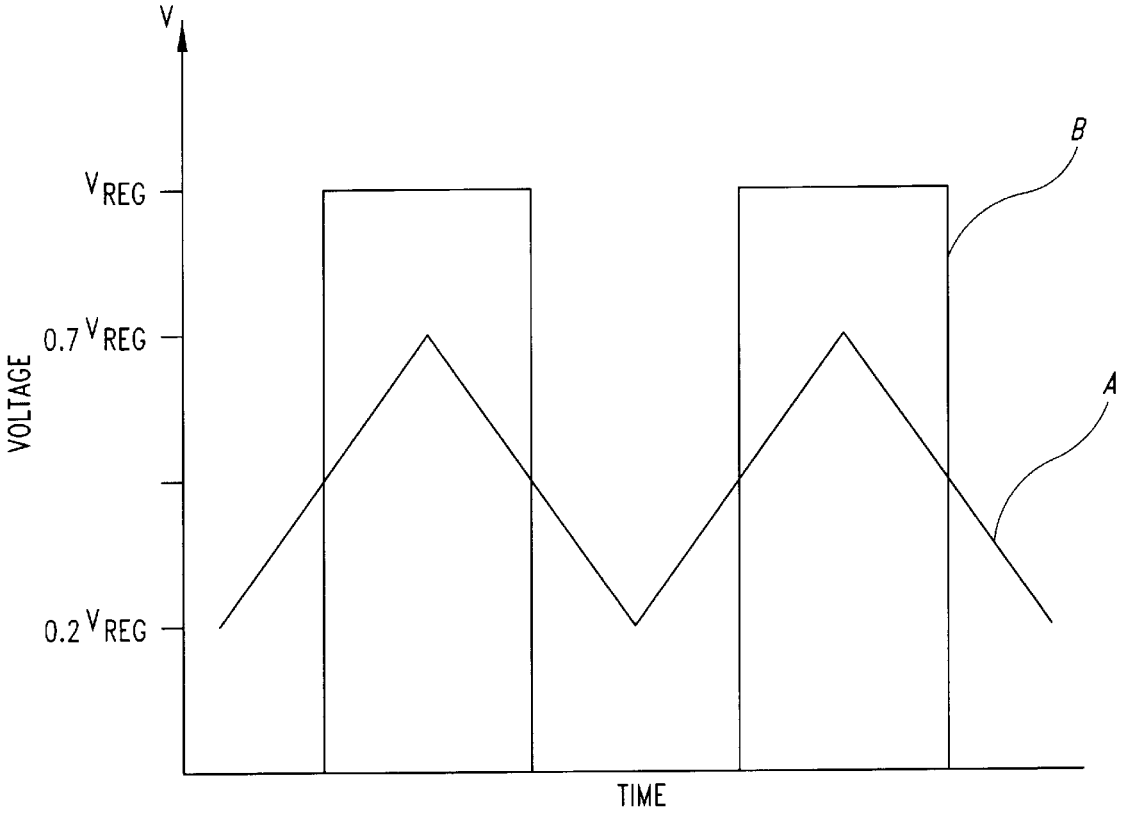
FIG. 8B shows sample waveforms generated by the voltage regulator of FIG. 8A.

The operation of the current steering circuit will now be described. The transistor 122 is activated by an appropriate voltage from the logic circuit 112. When activated, the scaled load current $\alpha I_{load}$ is directed through transistors 102 and 122 to charge the control capacitor C40. Thus, the control capacitor C40 is charged by a scaled load current $\alpha I_{load}$ that is proportional to the load current $I_{load}$. Because the control capacitor C40 is being charged by a current, the voltage on the control capacitor increases linearly as shown in waveform A of FIG. 8B. Returning again to FIG. 8A, when the voltage on the control capacitor C40 reaches the first voltage level, which is 0.7 $V_{reg}$. In the embodiment of FIG. 8A, the upper window comparator 110*a* triggers the logic circuit 112 and causes the transistor 122 to stop conducting (i.e., to turn off). When the transistor 122 stops conducting, the transistor 124 begins to conduct. In turn, the diode configured transistor 126 will begin to conduct the scaled load current $\alpha I_{load}$. It should be noted that the transistors 126 and 128 form a current mirror. In response to the current drain through transistor 126, the transistor 128 also conducts a current equal to the scaled load current $\alpha I_{load}$. Thus, the transistor 128 begins to discharge the control capacitor C40 at a rate determined by the scaled load current $\alpha I_{load}$. The voltage on the control capacitor C40 decreases in a linear fashion due to the discharge by the scaled current $\alpha I_{load}$. The resulting voltage waveform on the control capacitor C40 is a triangle wave, illustrated in waveform A of FIG. 8B. The control capacitor C40 will discharge until it reaches the second voltage level, which is 0.2 $V_{reg}$ in the embodiment of FIG. 8A. At that point, the lower window comparator 110*b* triggers the logic circuit 112 which, in turn, activates the transistor 122. When the transistor 122 is activated, the discharging cycle stops and the charging cycle begins. The resultant waveform A (see FIG. 8B) is a time-varying waveform whose voltage varies between the first and second voltage levels and whose frequency is dependent on the load current $I_{load}$. Thus, the circuit illustrated in FIG. 8A is a practical implementation of the ICO 80 shown in FIG. 6. In addition, the control voltages within the ICO 80 are coupled to the regulated output voltage $V_{reg}$ and are constrained to ensure proper operation of the ICO.

In the exemplary embodiment illustrated in FIG. 8A, the control capacitor C40 is alternatively charged and discharged by a current related to the load current $I_{load}$. The resultant voltage on the control capacitor C40 is the triangle wave illustrated in FIG. 8B whose frequency is dependent on the load current $I_{load}$. However, those of ordinary skill in the art can appreciate that different techniques may be used to charge and discharge the control capacitor C40 to produce a time varying waveform having the appropriate frequency. For example, the control capacitor C40 may be charged to the first voltage level by the scaled load current $\alpha I_{load}$ and quickly discharged to the second voltage level by any conventional circuit. In this embodiment, the voltage on the control capacitor C40 is a saw tooth waveform rather than the triangle waveform of FIG. 8B. In yet another alternative embodiment, the control capacitor C40 could be coupled in series with a linear resistor to create an RC timing circuit whose voltage increases exponentially. The present invention is directed to the generation of a time varying waveform whose voltage is related to the regulated voltage $V_{reg}$ and whose frequency is dependent on the load current $I_{load}$. The present invention is not limited by the specific waveform generated on the control capacitor C40 or the specific circuitry used to generate the waveform.

The control capacitor C40 is also connected to an input of a comparator 130. A reference input of the comparator 130 is coupled to a reference voltage of approximately 0.5 $V_{reg}$.

As the control capacitor C40 charges and the voltage on the control capacitor exceeds 0.5 $V_{reg}$, the output of the comparator 130 changes states to a first logic value. Similarly, when the control capacitor C40 discharges below 0.5 $V_{reg}$, the output of the comparator 130 changes states to a second logic value. In an exemplary embodiment, the comparator 130 includes hysteresis to reduce the effects of noise. The output of the comparator 130 is coupled to an inverter 132, which is connected serially to a second inverter 134. The comparator 130 converts the triangle wave, shown as waveform A in FIG. 8B, to a logic level clock signal. The inverter 134 provides the clock signal $\phi$ required for proper operation of the switched capacitor 44 (see FIG. 3). Well-known circuits may be readily employed to generate the non-overlapping clock signal $\bar{\phi}$. The output waveform of the ICO 80 is illustrated as waveform B in FIG. 8B.

The frequency of the ICO is given by the following:

$$f_{ICO} = \frac{\alpha}{V_{reg}} \frac{I_{load}}{C_{40}} \tag{9}$$

where all terms have been previously defined.

If the control capacitor C40 is selected to have a fixed relationship with respect to the load capacitance $C_L$, ($C_L$= m*C40), then the frequency of the ICO 80 is given by the following:

$$f_{ICO} = \frac{\alpha}{V_{reg}} \frac{m^* I_{load}}{C_L} \tag{10}$$

where all terms have been previously defined.

It may be seen that equation (10) has the same form as equation (8) above since the values of a, m, and the ratio of capacitors C32/C30 are constants. The circuit shown in FIG. 8A will operate satisfactorily despite any changes in the load current $I_{load}$ or in the value of the regulated voltage $V_{reg}$. In an exemplary embodiment, many components of the voltage regulator are integrated onto a common substrate to from an integrated circuit. The capacitors C30 and C32 may be incorporated into the integrated circuit thus permitting the close matching, or close ratio matching, of the capacitors using known techniques. Other components, such as the pass transistor 28 and the control capacitor C40 are external components that are coupled to pins of the integrated circuit.

Figure 9:
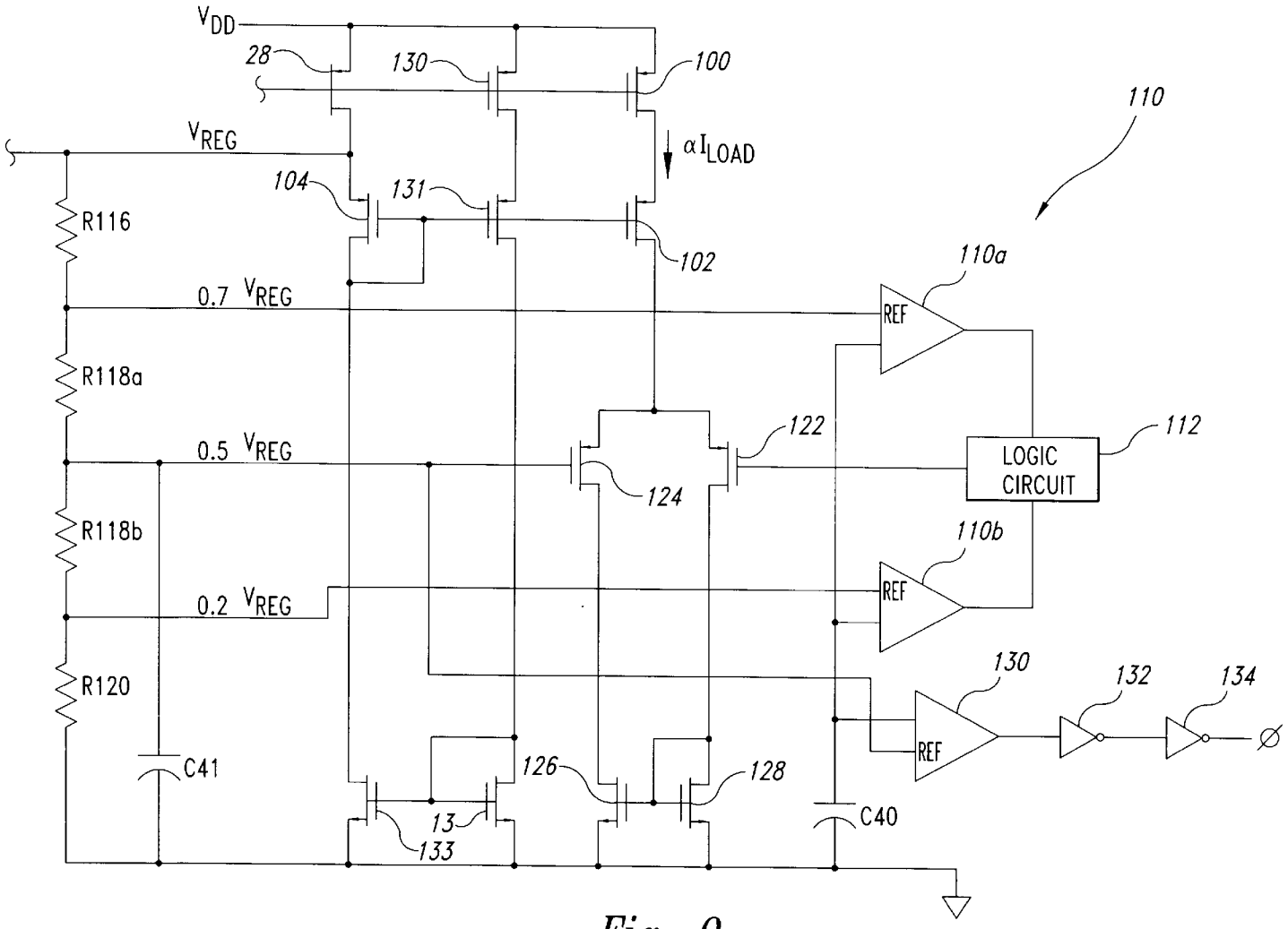
FIG. 9 is a detailed schematic diagram of an alternative embodiment of the present invention.

An alternative embodiment of the present invention is illustrated in FIG. 9. The window comparator 110, logic circuit 112, and current steering circuit comprising transistors 122–128, are identical to those components illustrated in FIG. 8A and operate in a manner previously described. FIG. 9 illustrates the generation of the $V_{ref}$=0.5 $V_{reg}$ voltage in the resistor divider 114. The resistor 118 in FIG. 8A is replaced by two resistors R118*a* and R118*b*. The resistors R118*a* and R118*b* are connected in series and have resistance values selected to generate a reference voltage of 0.5 $V_{reg}$ at a common node between the resistors R118*a* and R118*b*. This reference voltage is coupled to the gate of the transistor 124 and the reference input of the comparator 130 as previously described.

A filter capacitor C41 is coupled to the common node between the series connected resistors R118*a* and R118*b*. The capacitor C41 filters switching noise that may be generated by the transistor 124 or the comparator 130. If the capacitor C41 is integrated onto the substrate of the integrated circuit, a typical value of 5 picofarads may be used. The capacitor C41 may also be connected externally to the voltage regulator circuit and has a typical value of 0.01 microfarads in this embodiment. However, the precise value of the capacitance for the capacitor C41 is not critical.

The exemplary embodiment illustrated in FIG. 9 includes a current sensing transistor 130 whose gate and source that are connected to the gate and source, respectively of the pass transistor 28 and the current sensing transistor 100. A transistor 131 is cascode configured with its gate coupled to the gate of transistor 102 and the gate of transistor 104. The source of the transistor 131 is coupled to the drain of the current sensing transistor 130. The drain of the transistor 131 is coupled to the drain & gate of a diode configured transistor 132. The gate and drain of the transistor 132 are connected together to form the diode configuration. The source of the transistor 132 is coupled to the circuit ground. The current through the transistor 132 controls current in a transistor 133. The transistor 133 has a drain coupled to the gate and drain of the transistor 104. The gate of the transistor 133 is coupled to the gate and drain of the transistor 132 while the source of the transistor 133 is coupled to circuit ground. The transistors 130–133 allow the gate-to-source voltage $V_{GS}$ of the transistor 104 to accurately match the gate-to-source voltage $V_{GS}$ of the transistor 102 regardless of the load current $I_{load}$ thereby matching $V_{ds}$ of 100 & 28. Matching $V_{ds}$ on the output transistor 28 & the scaled current sense transistor 100 eliminates current mismatch due to finite Early Voltage (1/$\lambda$). In a preferred embodiment, the current of the current sensing transistor 100 is equal to the current of the current sensing transistor 130. Additionally, the transistors 132 and 133 are selected to match each other and the transistors 102, 104, and 131 are selected to match each other. The advantage of the circuit illustrated in FIG. 9 is that the gate-to-source voltage of transistors 102 and 104 accurately match regardless of load current while the embodiment of FIG. 8A provides a correct match only when the current through transistor 104 is equal to the current flowing through the transistor 102, as described above.

Therefore, the invention increases the stability of the voltage regulator 22 without increasing the power dissipated by the circuit. This is accomplished by having a load canceling zero which follows the load pole.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

What is claimed is:

1. A voltage regulator circuit to generate a regulated output voltage at a voltage regulator output using an error amp, an amplifier, a pass transistor, wherein the amplifier further comprises:

a compensation capacitor coupled to the amplifier;

a variable oscillator having an input coupled to the voltage regulator output to sense changes in current draw at the voltage regulator output, said variable oscillator being controlled by the regulated output voltage to generate a clock signal whose frequency is proportional to a current demand on the voltage regulator; and a switched capacitor having a clock input configured to receive said clock signal and operable to vary the zero of the voltage regulator as a function of the current draw on the voltage regulator output.

2. The voltage regulator circuit of claim 1, further comprising a control capacitor within said variable oscillator, said control capacitor being alternately charged to a first voltage level discharged to a second voltage level proportional to the regulated output voltage and less than said first voltage level with at least one of the charging and discharging of said control capacitor being accomplished using a control current proportional to the current draw on the voltage regulator output to generate a time-varying signal whose frequency is proportional to the current demand on the voltage regulator and the regulated output voltage.

3. The voltage regulator circuit of claim 2 wherein said first voltage level equals the regulated output voltage.

4. The voltage regulator circuit of claim 2 wherein said second voltage level equals a circuit ground reference voltage.

5. The voltage regulator circuit of claim 1, further comprising a control capacitor within said variable oscillator, said control capacitor being alternately charged to a first voltage level proportional to the regulated output voltage and discharged to a second voltage level proportional to the regulated output voltage and less than said first voltage level with at least one of the charging and discharging of said control capacitor being accomplished using a control current proportional to the current draw on the voltage regulator output to generate a time-varying signal whose frequency is proportional to the current demand on the voltage regulator and the regulated output voltage.

6. The voltage regulator circuit of claim 5 wherein said first voltage level equals the regulated output voltage.

7. The voltage regulator circuit of claim 5, further including a window comparator circuit coupled to said control capacitor and receiving said first and second control voltages, said window comparator circuit generating a capacitor control signal having a first control signal level to charge said control capacitor to said first voltage level and a second control signal level to discharge said control capacitor to said second voltage level.

8. The voltage regulator circuit of claim 7, further including a charging transistor coupled to said control capacitor and responsive to said capacitor control signal at said first control signal level to charge said control capacitor and a discharging transistor coupled to said control capacitor and responsive to said capacitor control signal at said second control signal level to discharge said control capacitor.

9. The voltage regulator circuit of claim 7 wherein said window comparator circuit includes hysteresis.

10. The voltage regulator circuit of claim 1, further including a current sensing transistor coupled to the pass transistor and said variable oscillator to generate a signal indicative of the current draw on the voltage regulator output.

11. The voltage regulator circuit of claim 10 wherein said current sensing transistor has a first terminal coupled to a corresponding terminal in the pass transistor and a control terminal coupled to a corresponding control terminal in the pass transistor, said current sensing transistor having a third terminal coupled to said variable oscillator.

12. The voltage regulator circuit of claim 1 wherein said variable oscillator is a voltage-controlled oscillator.

13. The voltage regulator circuit of claim 1 wherein said variable oscillator is a current-controlled oscillator.

14. The voltage regulator circuit of claim 1 wherein the switched capacitor comprises:

a first transistor having a drain, source, and a gate for receiving said clock signal;

a capacitor having a first end coupled to the drain of the first transistor and having a second end coupled to ground; and a second transistor having a drain coupled to the first end of the capacitor, having a source, and having a gate for receiving an inverted version of said clock signal.

15. An automatic stabilization circuit for a voltage regulator having a regulating element coupled to a regulator output terminal and connectable to a load to generate a regulated output voltage, a feedback element, and an amplifier having input and output terminals, the automatic stabilization circuit comprising:

a variable oscillator coupled to the regulator output terminal to receive the regulated output voltage and having a control input coupled to the regulator output terminal to sense current draw from the voltage regulator and an oscillator output, said variable oscillator using said regulated output voltage and said sensed current draw to generate a variable frequency clock signal whose frequency is dependent on the current draw from the voltage regulator; and a switched capacitor circuit coupled to the amplifier to provide variable compensation to the amplifier, the switched capacitor circuit receiving said variable frequency clock signal and generating a variable impedance whose value varies in response to changes in the frequency of said variable frequency clock signal.

16. The circuit of claim 15 wherein the switched capacitor is coupled in series between the input and output terminals of the amplifier.

17. The circuit of claim 15 wherein the regulating element is a pass transistor coupled between a voltage source and the output of the voltage regulator and having a control input coupled to the output of the amplifier.

18. The circuit of claim 15, further comprising a control capacitor within said variable oscillator, said control capacitor being alternately charged and discharged to generate a time-varying voltage signal whose frequency is proportional to the current draw from the voltage regulator with at least one of the charging or discharging of said control capacitor being accomplished by a control current proportional to the current draw from the voltage regulator output.

19. The circuit of claim 18 wherein said control capacitor is charged to a first voltage level proportional to the regulated output voltage and discharged to a second voltage level proportional to the regulated output voltage and less than said first voltage level to generate said time-varying voltage signal.

20. The circuit of claim 19 wherein said first voltage level equals the regulated output voltage.

21. The circuit of claim 18 wherein said control capacitor is charged to a first voltage level and discharged to a second voltage level less than said first voltage level to generate said time-varying voltage signal.

22. The circuit of claim 21 wherein said first voltage level equals the regulated output voltage.

23. The circuit of claim 21 wherein said second voltage level equals a circuit ground reference voltage.

24. The circuit of claim 18, further including an amplifier coupled to said control capacitor to amplify said time-varying voltage signal and thereby generate said variable frequency clock signal.

25. The circuit of claim 15, further including a current sensing transistor coupled to the regulating element and said variable oscillator to generate a signal indicative of the current draw from the voltage regulator.

26. A method for stabilizing a voltage regulator circuit generating a regulated output voltage, the method comprising the steps of:

sensing current draw from the voltage regulator circuit;

generating a variable frequency clock signal whose frequency is dependent on the current draw from the voltage regulator circuit and whose amplitude is dependent on the regulated output voltage; and generating a variable impedance whose value varies in response to changes in the frequency of said variable frequency clock signal to compensate the voltage regulator for changes in the current draw from the voltage regulator.

27. The method of claim 26 wherein said step of generating a variable impedance uses a switched capacitor circuit coupled to the amplifier to provide compensation to the voltage regulator.

28. The method of claim 26 wherein the step of generating a variable frequency clock signal includes the steps of alternately charging and discharging a control capacitor to first and second voltage values, respectively, that are dependent on the regulated output voltage to generate a time-varying voltage signal whose frequency is proportional to the current draw from the voltage regulator, with at least one of the charging and discharging of said control capacitor using a control current proportional to the current draw from the voltage regulator.

29. The method of claim 28 wherein said control capacitor is charged to a first voltage level proportional to the regulated output voltage by said control current and discharged by said control current to a second voltage level proportional to the regulated output voltage and less than said first voltage level to generate said time-varying voltage signal.

30. The method of claim 29 wherein said first voltage level is equal to the regulated output voltage.

31. The method of claim 28 wherein said control capacitor is charged to a first voltage level by said control current and discharged by said control current to a second voltage level less than said first voltage level to generate said time-varying voltage signal.

32. The method of claim 31 wherein said first voltage level is equal to the regulated output voltage.

33. The method of claim 31 wherein said second voltage level equals a circuit ground reference voltage.

* * * * *